US007703482B1

(12) United States Patent
Tiebout

(10) Patent No.: US 7,703,482 B1
(45) Date of Patent: Apr. 27, 2010

(54) LABIAL BOW BENDING DEVICE

(76) Inventor: Leigh A. Tiebout, P.O. Box 3577, Carbondale, IL (US) 62902

( * ) Notice: Subject to any disclaimer, the term of this patent is extended or adjusted under 35 U.S.C. 154(b) by 740 days.

(21) Appl. No.: 11/526,223

(22) Filed: Sep. 22, 2006

(51) Int. Cl.
*B21F 1/06* (2006.01)
*H01R 43/033* (2006.01)

(52) U.S. Cl. ..... 140/102.5; 140/102; 140/123

(58) Field of Classification Search ..... 140/102, 140/102.5, 52, 104, 123, 149
See application file for complete search history.

(56) References Cited

U.S. PATENT DOCUMENTS

| | | | | |
|---|---|---|---|---|
| 3,229,727 | A * | 1/1966 | Kenlon | 140/102.5 |
| 3,967,379 | A | 7/1976 | Bergersen | 433/6 |
| 4,248,274 | A * | 2/1981 | Lamoglia | 140/106 |
| 4,423,757 | A * | 1/1984 | Broberg, Jr. | 140/123 |
| 4,637,796 | A | 1/1987 | Korn | 433/7 |
| 4,751,840 | A * | 6/1988 | Windsor, Jr. | 72/478 |
| 2004/0072120 | A1 | 4/2004 | Lauren | 433/24 |

OTHER PUBLICATIONS

Bierschenk, K.H., D.M.D., Fabrication of Standardized Wire Elements for the Orthodontic Apparatus, Quintessence of Dental Technology, vol. 7, No. 6, Jun. 1983.
AEZ arch-Forming Turret (standard), http://www.dentalcompare.com, © 2005-2006.

* cited by examiner

*Primary Examiner*—Dana Ross
*Assistant Examiner*—Debra M Sullivan
(74) *Attorney, Agent, or Firm*—Grace J. Fishel

(57) ABSTRACT

A labial bow bending device for use in quickly and accurately forming a Hawley retainer or other removable orthodontic appliance. The bending device includes a turret with pins on opposite ends for forming a pair of standardized pre-measured vertical loops in an orthodontic wire for use in a maxillary or mandibular labial bow. A measuring scale is provided on the turret for establishing the distance between the vertical loops during formation of the labial bow such that the distal legs of the vertical loops pass between the canines and first bicuspids of a plaster model of a patient's teeth. The turret also includes a plurality of circular grooves of different diameters for use in forming an incisor section of the labial bow between the vertical loops into a smooth arc that conforms to the curve of the labial surfaces of the incisors on the plaster model.

8 Claims, 7 Drawing Sheets

LABIAL BOW BENDING DEVICE

BACKGROUND OF THE INVENTION

1. Field of the Invention

The present invention relates to a device for bending a wire to be used in the fabrication of a removable orthodontic appliance. More particularly, the device is for use in fabricating a retainer of the type having a wire against the labial surface of the upper or lower anterior teeth.

2. Brief Description of the Prior Art

At the present time, the procedure for making a removable orthodontic appliance is as follows. First, an impression of the teeth is made, from which is molded a plaster model of the patient's teeth. Wires are then shaped and adapted to the model and an acrylic plate is formed over the tag ends of the wires.

A labial bow is an important element in a Hawley retainer and is used in many other orthodontic appliances. When the retainer includes a labial bow, a length of wire is cut and a pair of vertical loops are formed in the canine areas separated by an incisor segment. The vertical loops ideally consist of parallel legs joined by a smooth curve. The loops are symmetrical and extend a short distance above the gingival margin. Either before the vertical loops are formed or after, the incisor segment is curved such that it passes across the labial surface of the incisors at the widest portion of the teeth just incisal to the interdental papilla. The wire should form a smooth arc, as symmetrical as possible while conforming to the curve of the labial surfaces of the incisors. Special pliers such as 139 pliers are used to form the vertical loops and a turret may be found helpful in shaping the incisor segment.

Making a proper labial bow requires skill and it is desirable to keep time to a minimum. Quality is improved if repeated bending is eliminated because repeated bending of the wire can lead to strain hardening and weakening in certain metals. Quality is also improved if handling of the wire by wire forceps is kept to a minimum as damage to the wire may lead to increased likelihood of breakage.

BRIEF SUMMARY OF THE INVENTION

In view of the above, it is an object of the present invention to provide a bending device which allows an operator to form standardized pre-measured vertical loops in a maxillary or mandibular labial bow quickly and without repeated bending to correct mistakes. It is another object to provide a bending device that allows an operator to quickly fit the labial bow to the labial surfaces of a plaster mold of a patient's teeth. Other objects and features of the invention will be in part apparent and in part pointed out hereinafter.

In accordance with the invention, a bending device for use in quickly fabricating a labial bow having a pair of standardized pre-measured, perfectly formed, vertical loops with parallel legs joined by a smooth curve separated by an incisor section formed as a smooth arc is provided. Bending device includes a turret with a plurality of bands and first and second ends. Each of the bands on the turret has an encircling groove and one or more of said bands has different diameters for use in forming the incisor section into a smooth arc.

Each end of the turret is outfitted with first and second pins. The first pin on the first end has a diameter adapted to form a smooth curve in a vertical loop of a labial bow for use on the upper teeth and the second pin on the first end is offset from the first pin a distance adapted to form a loop having a height for use on the upper teeth. On the second end, the first pin has a diameter adapted to form a smooth curve in a vertical loop of a labial bow for use on the lower teeth and the second pin is offset from the first pin a distance adapted to form a loop having a height for use on the lower teeth.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 3:
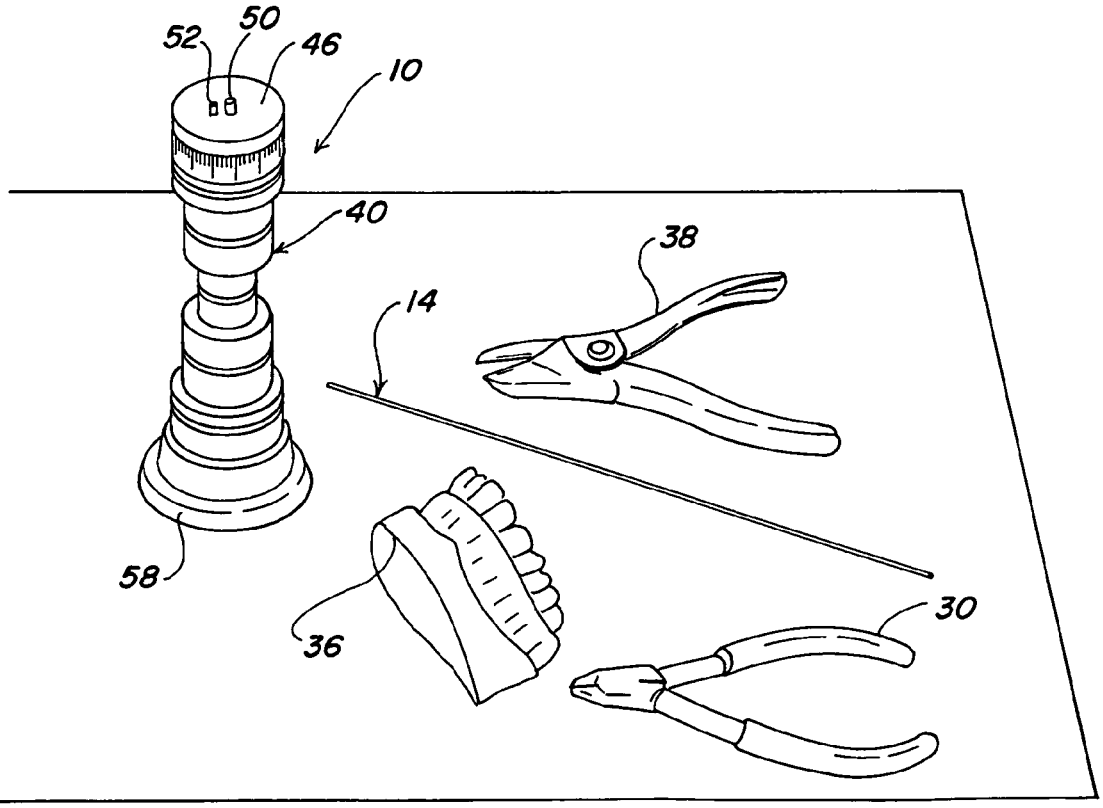
FIG. 3 is a perspective view of a set of tools which may be used with the bending device.
Figure 12:
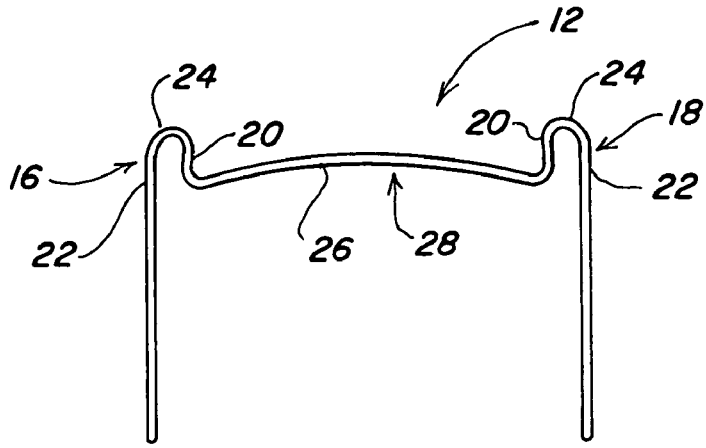
FIG. 12 is plan view of the labial bow.

Referring to the drawings more particularly by reference character, reference number 10 refers to a bending device for use in fabricating a standardized labial bow 12 as shown in FIG. 12 from a length of orthodontic wire 14 as shown in FIG. 3. Labial bow 12 has a pair of pre-measured vertical loops 16, 18 with parallel legs 20, 22 separated by a smooth curve 24. Mesial legs 20 of vertical loops 16, 18 are joined by an incisor section 26 formed in a smooth arc 28.

Figure 2:
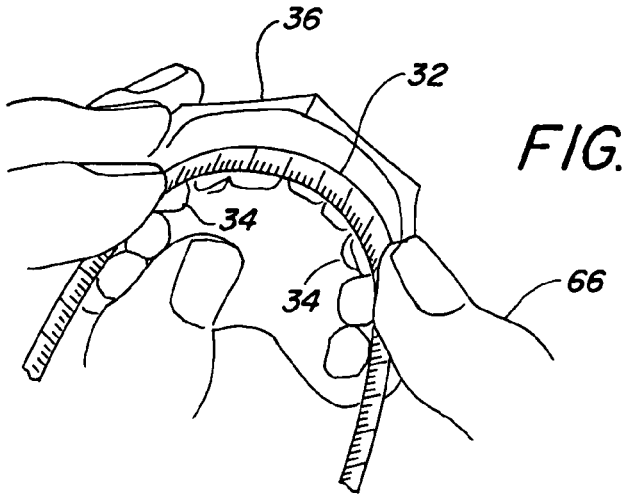
FIG. 2 is a perspective view of an operator measuring the distance between the distal of the canines on a plaster mold of a patient's teeth.

A set of tools for use with bending device 10 is shown in FIGS. 2-3. A pair of wire cutters 30 may be used to cut a length of orthodontic wire 14. Orthodontic wire 14 may be round or rectangular in cross-section and of various hardnesses and sizes. The materials out of which wire 14 is formed may also vary, including stainless steel, titanium-molybdenum alloys, nickel-titanium alloys and so forth. The present invention is adapted for use with a full range of orthodontic wires used in labial bows for removable orthodontic appliances. With continuing reference to FIGS. 2-3, a measure 32 may be used to determine the distance between the distal of canines 34 from a plaster mold 36 of the patient's teeth. A pair of 139 pliers 38 or the like may be used to make right angle bends in wire 14 as more particularly described hereinafter.

Figure 1:
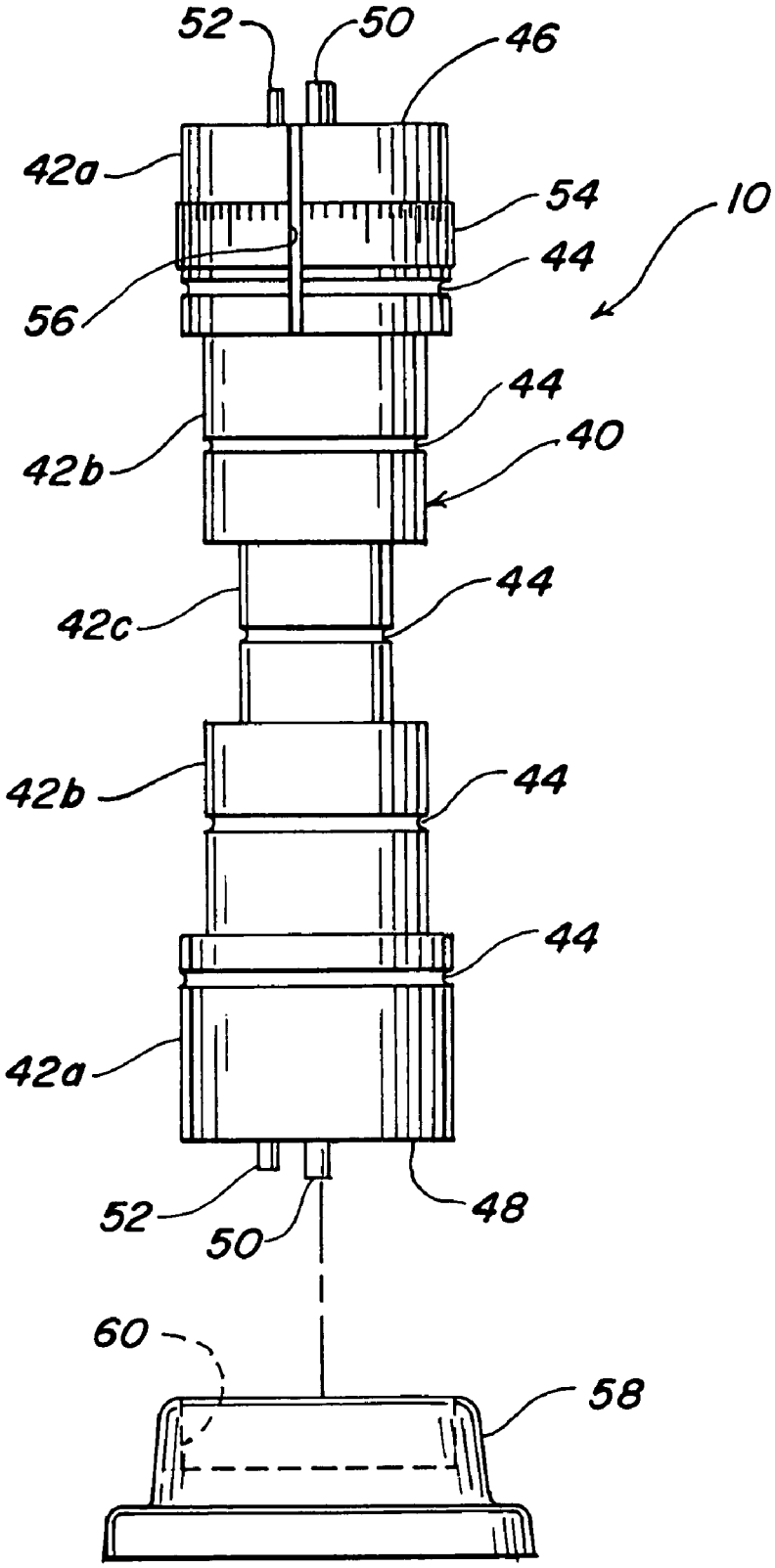
FIG. 1 is an exploded side elevation of a bending device in accordance with the present invention.

As shown in FIG. 1, bending device 10 includes a turret 40 formed as a tower or column. Turret 40 is provided with a plurality of bands 42 of different diameters for use in forming smooth arc 28 in incisor section 26 of labial bow 12. In the embodiment illustrated in the drawings, bands 42 are 1 inch in width. Upper and lower bands 42*a* have an outside diameter of 4 inches, intermediate bands 42*b* are 3.25 inches and band 42*c* is 2.50 inches. A half-round groove 44 (0.045 inch in diameter) is provided in each of bands 42. While bending device 10 with these dimensions is entirely satisfactory, it will be understood that the invention is not limited to the particulars. For example, groove 44 may have a different diameter or be rectangular in cross-section and more or less bands 42 may be provided. Bands 42 may be similar sized or different in width, etc. without affecting the utility of bending device 10.

Turret 40 has first and second ends 46, 48 on which first and second pins 50, 52 are located. The diameter and spacing between pins 50, 52 determines the diameter of smooth curve 24 of vertical loops 16, 18 and the length of mesial leg 20 thereby standardizing vertical loops 16, 18 in labial bow 12. First end 46 is designed for use in forming a maxillary labial bow for use on the upper teeth and second end 48 for forming a mandibular labial bow for use on the lower teeth.

When first and second pins 50, 52 at first end 46 are 6 mm apart on center and first pin 50 has a diameter of 5 mm and second pin 52 a diameter of 2.5 mm, standardized pre-measured vertical loops 16, 18 may be formed with smooth curve 24 having a diameter of about 6 mm and mesial leg 20 a length of about 6 mm for use in a maxillary labial bow 12. For most purposes, when labial bow 12 is used in a retainer with incisor section 26 against the widest portion of the teeth just incisal to the interdental papilla, vertical loops 16, 18 desirably extend a short distance above the gingival margin. When first and second pins 50, 52 on second end 48 are 5 mm part on center with first pin 50 being 3 mm in diameter and second pin 52 being 2 mm in diameter, standardized pre-measured vertical loops 16, 18 may be formed with smooth curve 24 having a diameter of about 5 mm and mesial leg 20 a length of about 5 mm for use in a mandibular labial bow 12. The height of first pin 50 on first and second ends 46, 48 may be 4 mm. The height of second pin 52 on first end 46 may be 3 mm and 2.5 mm on second end 48. While specifics have been provided regarding the diameter, spacing and height of first and second pins 50, 52, it will be apparent that the present invention is not limited to these particulars.

A measuring device 54 may be provided on one of bands 42 and a vertical groove 56 may be provided adjacent an end of measuring device 54 for receipt of a distal leg 22 of labial bow 12 during the formation thereof. A base 58 with a socket 60 for receipt of either first or second end 46, 48, respectively, of turret 40 may be provided.

Bending device 10 may be used to form a standardized, pre-measured labial bow 12 (FIG. 12) for use as an element of a Hawley retainer or for use in some other removable orthodontic appliance. For use in a Hawley retainer, distal legs 22 of vertical loops 16, 18 are bent such that they pass between canines 34 and first bicuspid 62 (FIGS. 13-14) and down towards the pallet. A retentive tag 64 (FIG. 14) is preferably formed in the ends of distal legs 22 such that the stay embedded in an acrylic plate (not shown) which together with Adams clasps (not shown) complete a Hawley retainer.

The process of forming labial bow 12 is shown in FIGS. 4-11 using the tools shown in FIGS. 2-3. As a preliminary step, an operator 66 uses measure 32 to determine the distance between the distal of canines 34 in plaster mold 36 and a length of orthodontic wire 14 is cut with wire cutters 30.

Figure 4:
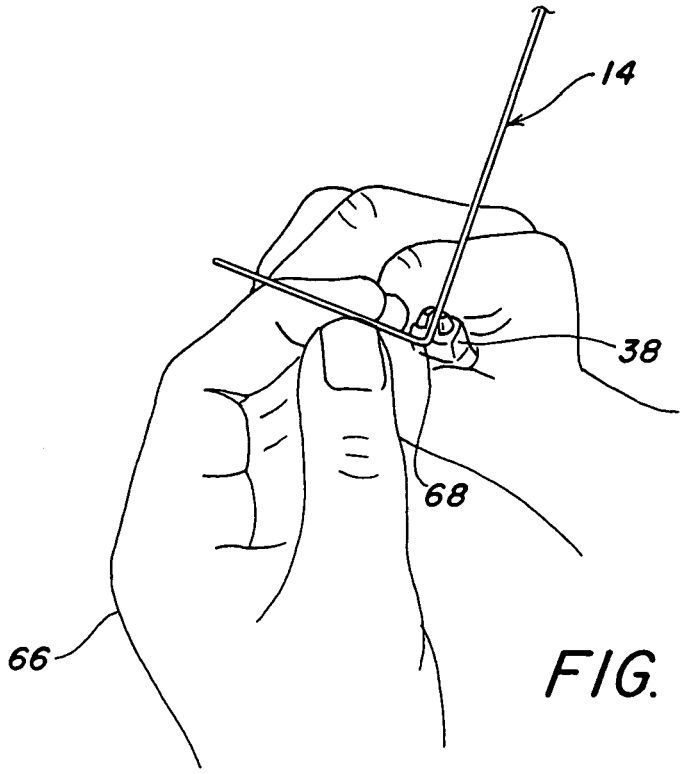
FIG. 4 is a perspective view of a right angle bend being formed in an orthodontic wire.
Figure 5:
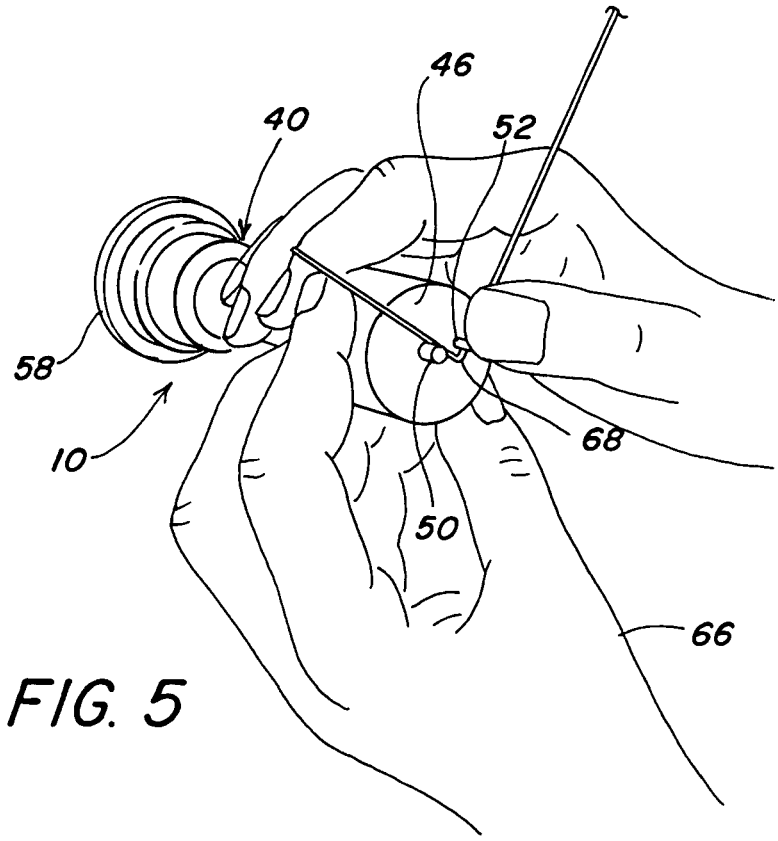
FIG. 5 is a perspective view of the right angle bend being placed against a smaller of two pins on an end of the bending device.
Figure 6:
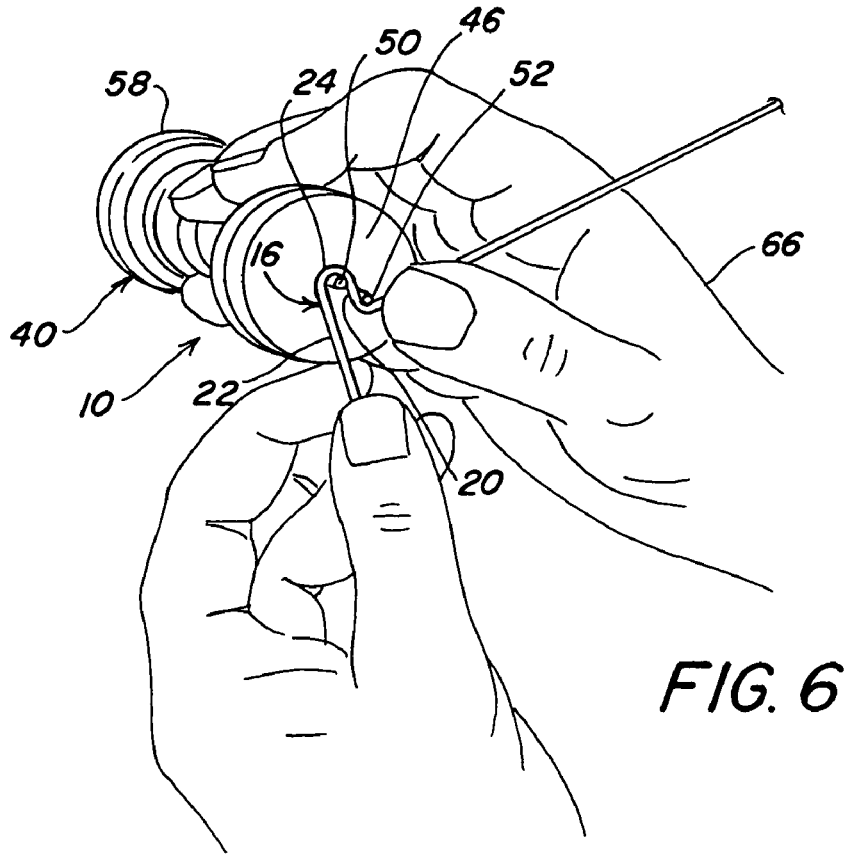
FIG. 6 is perspective view of the wire with the right angle bend being bent around a larger of the two pins forming a first vertical loop of a labial bow.

As shown in FIG. 4, operator 66 makes a right angle bend 68 at approximately one-third the length of wire 14. As shown in FIG. 5, right angle bend 68 is placed against second pin 52 on first end 46 for use in constructing a maxillary labial bow 12. If a mandibular labial bow 12 is required, turret 40 is inverted in base 58 such that first and second pins 50, 52 on second end 48 are available for use and steps 4-11 followed as described hereinafter with respect to first end 46. First vertical loop 16 is formed as shown in FIG. 6 by bending wire 14 around first pin 50 on first end 46 with the fingers. As shown, mesial leg 20 and distal leg 22 in first vertical loop 16 are parallel and smooth curve 24 is formed without the use of forceps which might otherwise nick the wire.

When labial bow 12 is completed, it is desirable that mesial legs 20 of vertical loops 16, 18 overlie the distal third of lateral incisors 70 or the mesial third of canines 34 as ordered by an orthodontist. In labial bow 12 shown in FIGS. 13-14, mesial legs 20 overlie the mesial third of canines 34.

Figure 7:
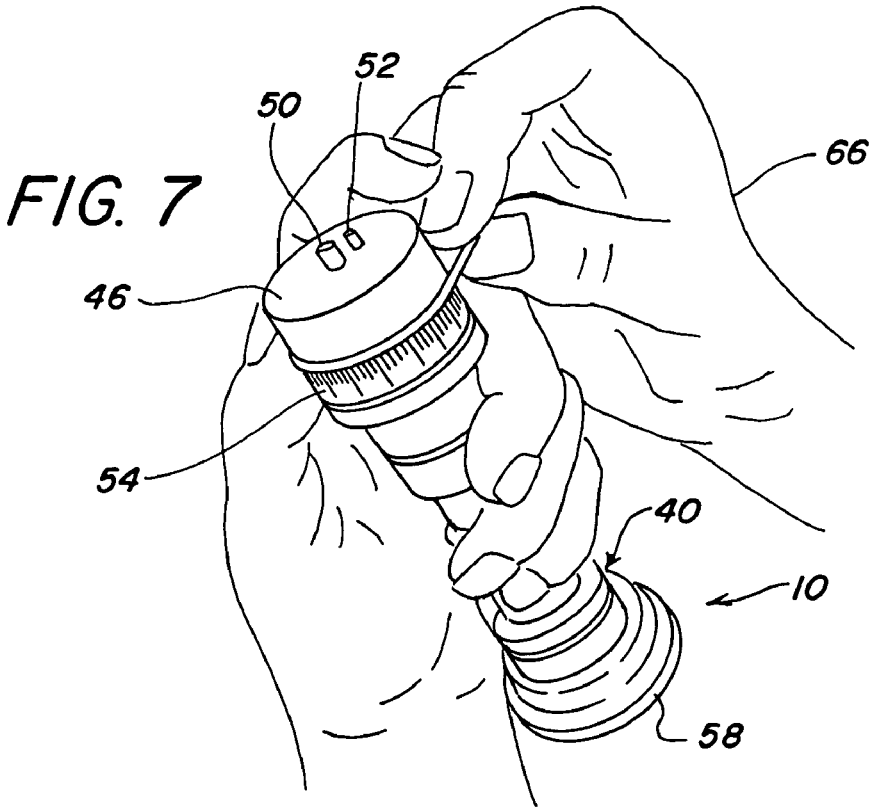
FIG. 7 is a perspective view of the wire being measured on the bending device such that the point at which a second right angle bend should start can be marked.

Using the measurement previously taken from plaster mold 36, as shown in FIG. 7 the distance between vertical loops 16, 18 is set using measuring device 54 on turret 40. Distal leg 22 of first vertical loop 16 may be received in groove 56 and scale of measuring device 54 positioned with respect to groove 56 such that when wire 14 is marked at a point corresponding to the measurement taken from the plaster mold 36, incisor section 26 will be of proper length and vertical loops 16, 18 will be properly positioned.

Figure 8:
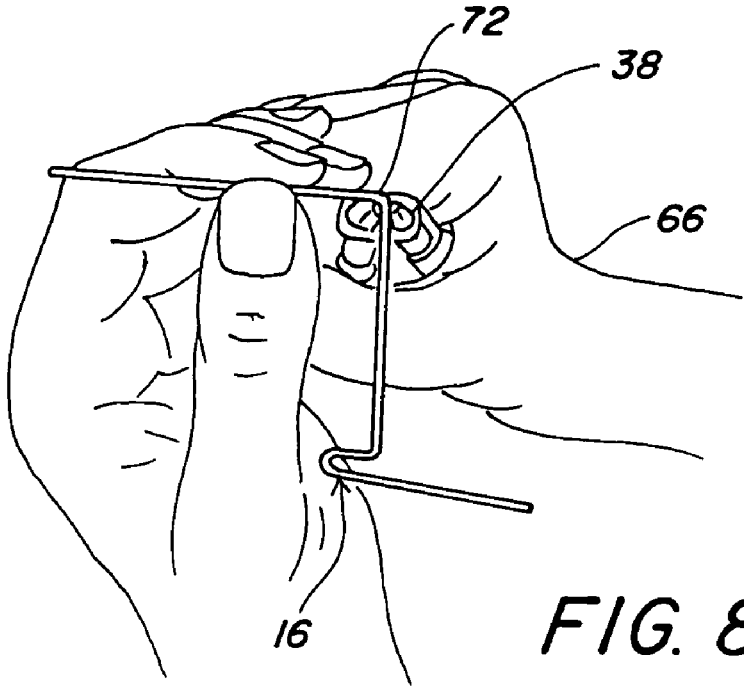
FIG. 8 is a perspective view of a second right angle bend being formed in the orthodontic wire at the point marked in FIG. 7.
Figure 9:
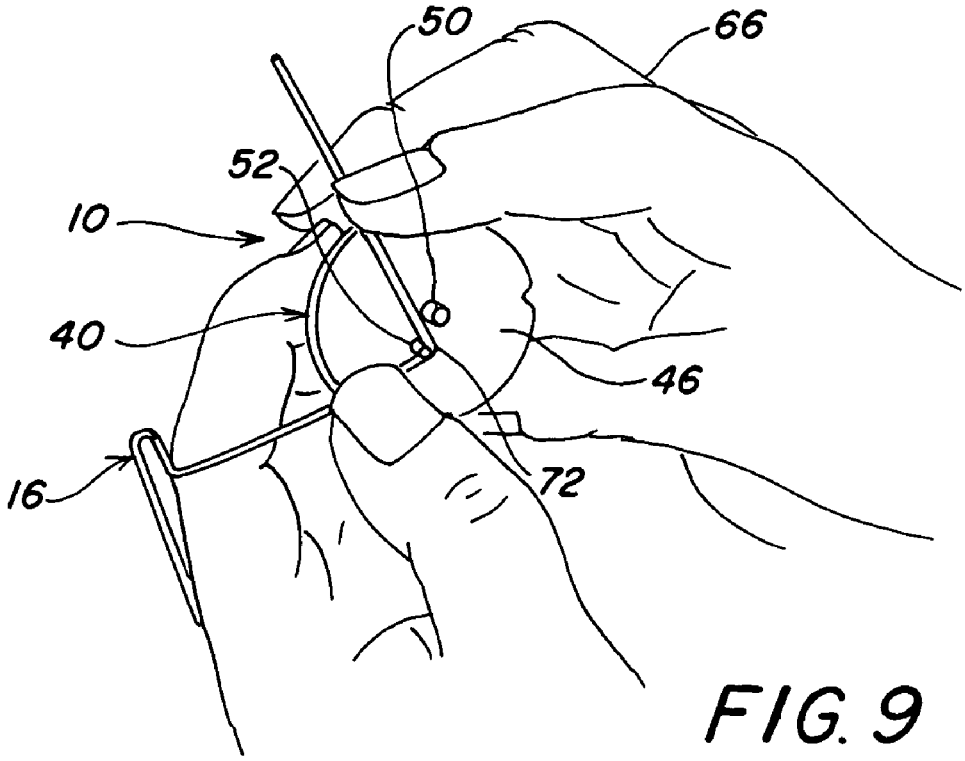
FIG. 9 is a perspective view of the second right angle bend being placed against the smaller of the two pins on the end of the bending device.
Figure 10:
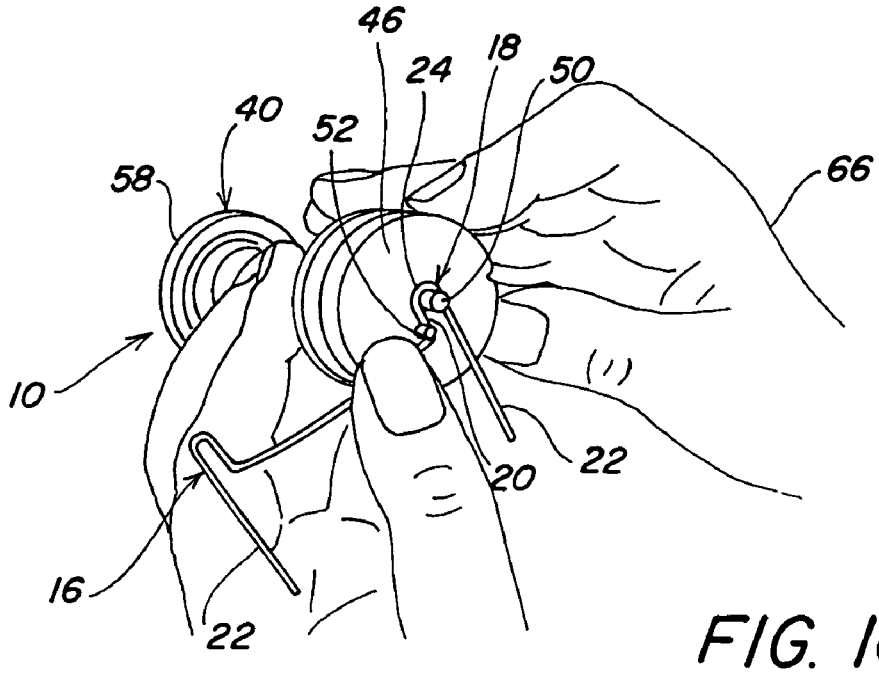
FIG. 10 is a perspective view of the wire being bent around the larger of the two pins forming a second vertical loop of the labial bow.

Referring now to FIG. 8, a second right angle bend 72 is formed in wire 14 at the point marked in FIG. 7. As shown in FIG. 10, right angle bend 72 is placed against second pin 52 on first end 46 and second vertical loop 18 is formed as shown in FIG. 10 by bending wire 14 around first pin 50 with the fingers. As shown, mesial leg 20 and distal leg 22 in second vertical loop 18 are parallel and smooth curve 24 is formed.

Figure 11:
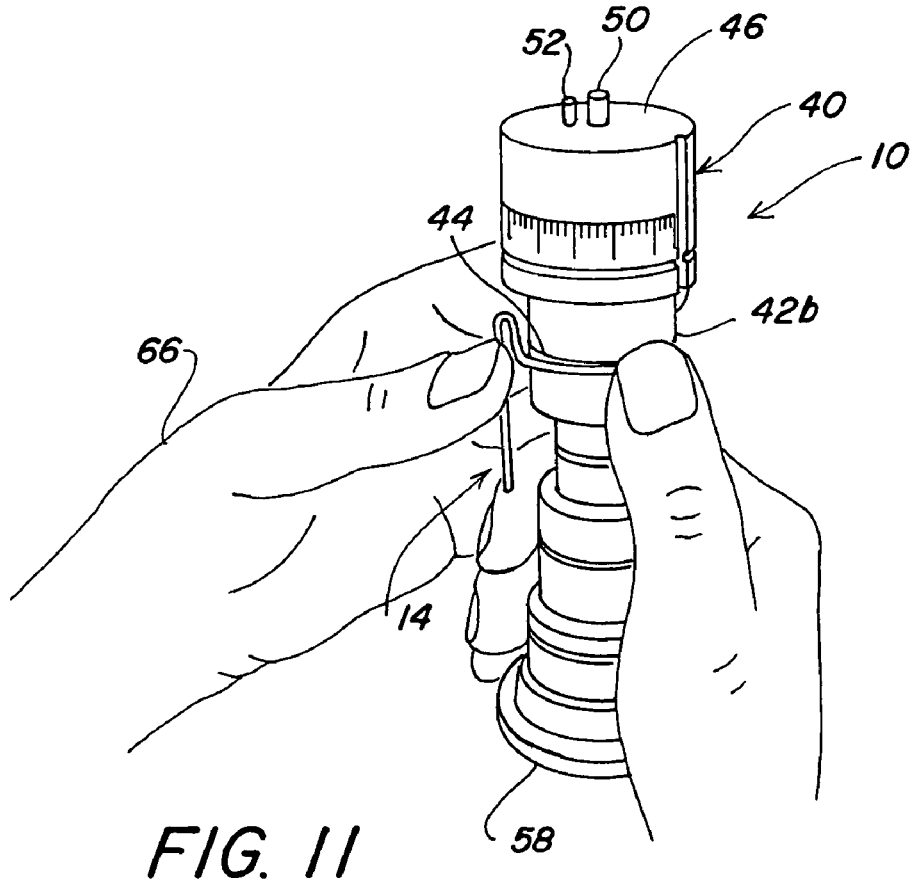
FIG. 11 is a perspective view of the incisor section between the vertical loops being formed into a smooth arc in a groove provided in a band on the bending device.

As shown in FIG. 11, using one of grooves 44 in one of bands 42*b* and the fingers, operator 66 may form smooth arc 28 in incisor section 26 such that labial bow 12 conforms to the curve of the labial surfaces of the incisors of plaster mold 36. As a matter of choice, other operators may prefer to form smooth arc 28 in wire 14 with turret 40 before forming first or second vertical loops 16, 18.

Figure 13:
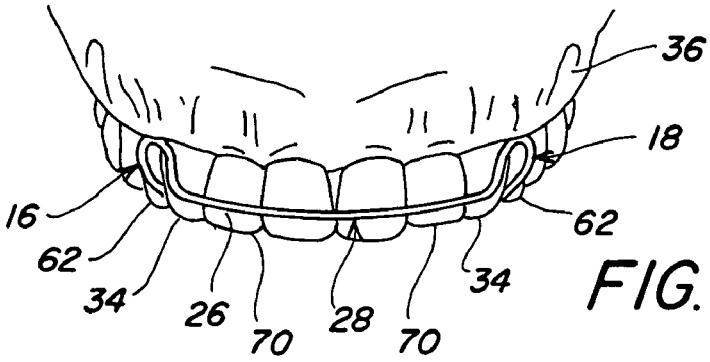
FIG. 13 is a front elevational view of the labial bow fitted on the plaster mold; and, FIG. 14 is plan bottom view of the plaster mold with the labial bow fitted as shown in FIG. 12.
Figure 14:
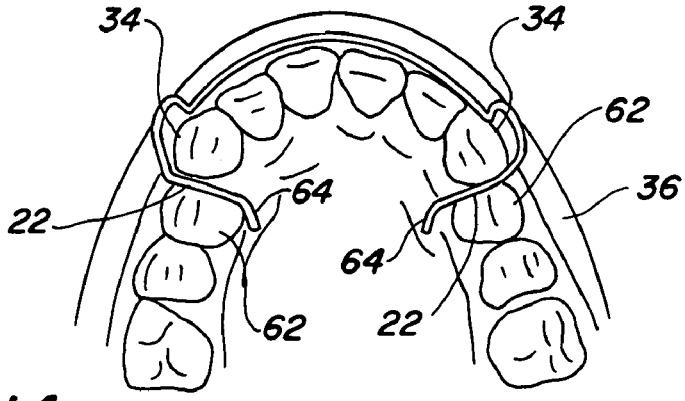

The finished product shown in FIG. 12 is a standardized pre-measured labial bow 12 which may be incorporated as an element of a Hawley retainer as shown in FIGS. 13-14 or used in some other orthodontic appliance requiring a labial bow. Bending device 10 permits the formation of perfect vertical loops 16, 18 and a labial bow 12 with a smooth arc 28. The vertical loops 16, 18 are quickly formed without repeated bending to correct mistakes and with minimal forceps handling. This decreases laboratory time needed to form a labial bow and improves quality, making bending device 10 a handy addition to an operator's tool kit.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A bending device for use in fabricating a labial bow having a pair of vertical loops with parallel legs joined by a smooth curve separated by an incisor section formed as a smooth arc comprising a turret with a plurality of bands and first and second ends, each of said bands having an encircling groove formed in the band and one or more of said bands having different diameters, said grooves being substantially identical in depth and configuration, each of said ends having first and second pins, said first pin on the first end having a diameter adapted to form a smooth curve in a vertical loop of a labial bow for use on the upper teeth, said second pin on the first end offset from the first pin a distance adapted to form a loop having a height for use on the upper teeth;

said first pin on the second end having a diameter adapted to form a smooth curve in a vertical loop of a labial bow for use on the lower teeth, said second pin on the second end offset from the first pin a distance adapted to form a loop having a height for use on the lower teeth;

whereby the vertical loops in a labial bow may be formed from a length of orthodontic wire for use on the upper teeth by using the first and second pins on the first end and the first and second pins on the second end for a labial bow for use on the lower teeth with the incisor section between the loops of the labial bow being formed into a smooth arc by using the groove in one or more of the bands.

2. The bending device of claim 1 further comprising a measuring scale on one or more of the bands for establishing the distance between the vertical loops during formation of a labial bow.

3. The bending device of claim 2 wherein a vertical groove is provided in one of the bands on the turret for receipt of a distal leg of a first of the vertical loops adjacent an end of the measuring scale.

4. The bending device of claim 1 further comprising a base with a socket for receipt of the first or second end of the turret.

5. A bending device for use in fabricating a labial bow having a pair of vertical loops with parallel legs joined by a smooth curve separated by an incisor section formed as a smooth arc comprising a turret with a plurality of bands and first and second ends, each of said bands having an encircling groove and one or more of said bands having different diameters, each of said ends having first and second pins, said first pin on the first end having a diameter of about 5 mm to form a smooth curve in a vertical loop of a labial bow for use on the upper teeth, said second pin on the first end having a diameter of about 2.5 mm and offset on center from the first pin about 6 mm to form a loop having a height of about 6 mm for use on the upper teeth;

said first pin on the second end having a diameter of about 3 mm to form a smooth curve in a vertical loop of a labial bow for use on the lower teeth, said second pin on the second end having a diameter of about 2 mm and offset on center from the first pin about 5 mm to form a loop having a height of about 5 mm for use on the lower teeth;

whereby the vertical loops in a labial bow may be formed from a length of orthodontic wire for use on the upper teeth by using the first and second pins on the first end and the first and second pins on the second end for a labial bow for use on the lower teeth with the incisor section between the loops of the labial bow being formed into a smooth arc by using the groove in one or more of the bands.

6. The bending device of claim 5 further comprising a measuring scale on one or more of the bands for establishing the distance between the vertical loops during formation of a labial bow.

7. The bending device of claim 6 wherein a vertical groove is provided in one of the bands on the turret for receipt of a distal leg of a first of the vertical loops adjacent an end of the measuring scale.

8. The bending device of claim 5 further comprising a base with a socket for receipt of the first or second end of the turret.

* * * * *